US006976428B2

(12) United States Patent
Riepenhoff et al.

(10) Patent No.: US 6,976,428 B2
(45) Date of Patent: Dec. 20, 2005

(54) WET OFFSET PRINTING FORM

(75) Inventors: Matthias Riepenhoff, Bern (CH); Olivier Stehlin, Moutier (CH)

(73) Assignee: Maschinenfabrik WIFAG, Bern (DE)

( * ) Notice: Subject to any disclaimer, the term of this patent is extended or adjusted under 35 U.S.C. 154(b) by 0 days.

(21) Appl. No.: 10/775,951

(22) Filed: Feb. 10, 2004

(65) Prior Publication Data

US 2004/0168599 A1 Sep. 2, 2004

Related U.S. Application Data

(62) Division of application No. 10/109,476, filed on Mar. 28, 2002.

(30) Foreign Application Priority Data

Mar. 29, 2001 (DE) ..... 101 15 435

(51) Int. Cl.[7] ..... B41C 1/10
(52) U.S. Cl. ..... 101/467; 101/451; 101/478
(58) Field of Search ..... 101/451, 456, 101/463.1, 465–467, 478; 430/302

(56) References Cited

U.S. PATENT DOCUMENTS 5,317,970 A * 6/1994 Nussel et al. ..... 101/478
5,365,847 A * 11/1994 Pers ..... 101/248
5,694,848 A * 12/1997 Palmatier ..... 101/219
6,318,264 B1 * 11/2001 D'Heureuse et al. ..... 101/467
6,391,522 B1 * 5/2002 Nakayama et al. ..... 430/273.1
6,420,091 B1 * 7/2002 Nakayama et al. ..... 430/302
2002/0017209 A1 * 2/2002 Gutfleisch et al. ..... 101/424

FOREIGN PATENT DOCUMENTS

| | | | |
|---|---|---|---|
| DE | 196 12 927 | A1 | 11/1996 |
| EP | 0 769 372 | A1 | 4/1997 |
| EP | 0 875 395 | A1 | 11/1998 |
| EP | 0 911 155 | A1 | 4/1999 |
| EP | 1 020 304 | A2 | 7/2000 |
| JP | 2001-105761 | | 4/2001 |

* cited by examiner

*Primary Examiner*—Stephen R. Funk
(74) *Attorney, Agent, or Firm*—McGlew and Tuttle, P.C.

(57) ABSTRACT

A wet offset printing form has a top layer containing a photocatalytically and thermally modifiable material. The material can be brought photocatalytically into a hydrophilic state by irradiation with light and into a lipophilic state by heating. The hydrophilic state forms a surface that can be illustrated and the lipophilic state forms an illustrated surface. The top layer of the wet offset printing form may contain absorption centers for irradiation, especially for laser radiation in the NIR range, with which heating of the top layer in the pattern of an image is brought about.

24 Claims, 3 Drawing Sheets

WET OFFSET PRINTING FORM

CROSS REFERENCE TO RELATED APPLICATION

This is a Divisional of application Ser. No. 10/109,476 filed Mar. 28, 2002, and the entire disclosure of this prior application is considered to be part of the disclosure of this application and is hereby incorporated by reference herein.

FIELD OF THE INVENTION

The present invention pertains to a wet offset printing form with a surface that can be or is illustrated with a printing style, wherein this surface is formed by a material that contains a photocatalytically and thermally modifiable material as a component in a uniform distribution or consists of such a material alone. A photocatalytically and thermally modifiable material is defined in the sense of the present invention as a material that can be brought into a hydrophilic state photocatalytically by irradiation with light and into a lipophilic state thermally, namely, by heating. Furthermore, the present invention pertains to a process for producing the printing style, i.e., for illustrating a printing style, to a process for erasing a printing style, to a device for illustrating a printing style and to a device for erasing a printing style of a wet offset printing form of the said type. The present invention especially preferably pertains to a process and to a device for illustrating and erasing a printing form, e.g., for illustrating the same printing form with different printing styles several times. The printing form, the process and the device are preferably used in web-fed rotary printing, especially in newspaper printing.

Illustrating is defined below as an operation in which the printing form is acted on in the areas that form the pixels, so that a latent image is produced on the printing form. Erasing is defined in the sense of the present invention as an operation in which the printing form is treated, preferably not in an image-dependent manner but over its entire surface, such that the image information applied during the illustration, i.e., the printing style, is eliminated. The action taking place during the illustration is preferably heating in the pattern of an image, but it may, in principle, also be irradiation with UV light in the pattern of an image.

BACKGROUND OF THE INVENTION

Newspapers are produced predominantly by wet offset. Printing presses to which the present invention preferably pertains typically contain printing units with rubber blanket cylinders, plate cylinders, inking units and damping units. A printing form mounted on a printing form cylinder has a surface mostly in the form of a top layer, which has hydrophilic (water-attracting) and lipophilic (water-repelling) areas in the illustrated state. The printing form is usually formed by a printing plate, which is mounted on a printing form cylinder designed as a plate cylinder. The printing form has lipophilic areas applied in the pattern of an image. The non-image areas are hydrophilic and bind water more strongly than ink. The lipophilic areas repel water and therefore exert an ink-attracting action. In principle, any surface that can be divided into hydrophilic and lipophilic areas may be used for the offset process.

A large number of processes and devices using corresponding printing forms are known for producing printing forms. For example, a printing form can be irradiated with a laser in the pattern of an image and subsequently developed chemically. Furthermore, printing forms can be prepared by laser ablation. In this process, lipophilic areas are exposed under a hydrophilic layer or hydrophilic areas are exposed under a lipophilic layer. The exposure operation that is decisive for producing the image may be carried out either in a separate unit or within the printing press, as is preferred according to the present invention. The outer drum principle is known for exposure or illustration in the printing press. So-called process-free printing forms, which do not require any chemical development, are used in most cases.

The printing forms used currently are used only once. However, it is desirable for economic and ecological reasons to be able to use these printing forms several times.

The illustration of a printing form by a photocatalytic reaction is known from EP 0 911 155 A1. To produce the printing style, the hydrophilic non-image areas are irradiated with UV laser light. The printing form thus exposed and illustrated as a result is erased by heating. The printing form must reach a high temperature in the process. Furthermore, a cleaning means is needed for erasing of the printing style after the use of the printing form in order to remove the ink residues from the printing form. Without cleaning, heating of the printing form to erase the printing style would bring about the burning in of ink residues in the surface of the printing form, as a result of which the printing form would become unusable.

EP 0 911 154 A1 describes the illustration by heating in the pattern of an image and the erasing by UV irradiation. Further details are described in EP 1 020 304 A2.

SUMMARY OF THE INVENTION

The primary object of the present invention is to provide a wet offset printing form of the type mentioned, which makes it possible to produce a printing style with good definition. After use, the printing form preferably does not have to be cleaned specifically for erasing the printing style. The illustration of a printing form and/or the erasing of a printing style of a printing form shall be facilitated, preferably in a wet offset printing press.

The present invention is based in a preferred embodiment on the idea of bringing about the local wetting behavior, i.e., the hydrophilic or lipophilic behavior of a printing form, by converting the atoms or molecules of a photocatalytically and thermally modifiable material, which forms the surface of the printing form that can be or is illustrated, from the excited state, in which they normally are, into a low-energy state by the illustration. Conversely, the atoms or molecules are converted from the low-energy state into the excited state during the erasing. Before the illustration operation is performed or after an erasing operation is performed, the printing form is thus in a hydrophilic initial state, which is converted by a local, preferably short-term heating of the photocatalytically and thermally modifiable material in the pattern of an image into the state of use that is lipophilic and hydrophilic in the pattern of an image.

One advantage of this type of illustration is that the non-illustrated printing form can be handled in daylight without problems. The erasing of the printing style rather than the illustration is carried out by the action of natural or artificial daylight or UV light, preferably on the surface having the printing style over the entire area. On the other hand, the loss of an illustration in the mounted state of the printing form is unlikely, because the printing form is no longer exposed to daylight, which could lead to erasing to a relevant extent, in the printing press. Another advantage is the self-cleaning property of the surface formed by the photocatalytically and thermally modifiable material, which becomes noticeable during the erasing of the image. Not only does the surface of the printing form become hydrophilic, but organic residues are also catalytically oxidized. Contrary to the erasing operation by means of full-area heating, cleaning of the printing form for the purpose of erasing is therefore not necessary. A full-area heating to the high temperatures necessary can be carried out within the printing press by little greater effort than an irradiation with daylight or UV light. The natural daylight has, in particular, short-wave, ultraviolet light (UV), which brings about the normally occurring hydrophilic character of the photocatalytically and thermally modifiable material.

Due to the illustration of the printing form by local irradiation in the pattern of an image, preferably by laser irradiation, only a near-surface in-depth area of the printing form is briefly heated locally rather than the entire printing form. The printing form as a whole remains at ambient temperature, which corresponds, in general, to the usual room temperature.

In a top layer, on the surface of which the printing style is produced, the printing form according to the present invention has absorption centers for a radiation, or radiation absorption regions in order to produce heat in the top layer by absorbing this radiation. The absorption centers are formed by particles of a material that absorb light, preferably infrared light (IR), which may extend into the visible range, i.e., into the near infrared range (NIR). The absorption material is uniformly dispersed in the form of fine particles in the photocatalytically and thermally modifiable material. The particles of the absorption material are preferably nanoparticles, i.e., particles whose maximum extension in space is in the nanometer range.

A photocatalytically and thermally modifiable material is already created in a single material layer by the uniform, fine distribution of the absorption centers in the photocatalytically and thermally modifiable material. The prior-art photocatalytic materials are known to be transparent. The transparency is the direct consequence of the band structure of the material. Indeed, a band gap greater than 3 eV is necessary to bring about the excitation of the photocatalytic material into a state in which the binding of OH groups to the surface of the material in question is possible. However, an interaction with low-energy, longer-wave photons is not possible at this band gap energy. The prior-art photocatalytic semiconductors are therefore transparent in the visible range. A photothermal effect and a change in the photocatalytic material can therefore be brought about only indirectly. The present invention provides a photocatalytically and thermally modifiable material due to the fine distribution of the absorption centers in the photocatalytically and thermally modifiable material. Semiconductors are especially preferred examples of materials for forming the absorption centers.

The top layer, which forms the surface that is to be illustrated or is already illustrated, thus comprises a material that photocatalytically interacts with light and the absorption centers, which are finely distributed in the photocatalytically interacting material, hereinafter also called simply photocatalytic material. The photocatalytic material interacts with light whose wavelength is shorter than the wavelength or the wavelength range of the radiation that is absorbed by the absorption centers and is converted into heat. Based on its band gap energy of at least 3 eV, the photocatalytic material interacts only with light whose wavelength is shorter than 400 nm. The material that forms the absorption centers consequently interacts with radiation whose wavelength is 400 nm or longer, and it preferably absorbs light from the IR wavelength range.

A new material that possesses both photocatalytic and absorbing properties is created by the present invention. One advantage is that the coating of a carrier material can be simplified, because both interactions, namely, the photocatalysis and the absorption, take place in a single layer, and it is therefore possible to do away with an absorption layer intended exclusively for the absorption. Furthermore, the thickness of the layer of the photocatalytically and photothermally modifiable material is less critical. While the thickness of the photothermally modifiable top layer exerts a strong effect on heating in the case of a multilayer system, more uniform heating can be achieved within a single layer if the absorption centers are homogeneously distributed in this layer. Furthermore, the heat-generating absorption centers are closer to the surface that can be or is already illustrated, so that sharper temperature gradients are possible in the surface.

The possibility of producing especially sharper temperature gradients on the surface is especially advantageous for the preferred illustration by heating in the pattern of an image, because the definition of the printing style is improved. However, the printing form according to the present invention is also advantageous, in principle, for an illustration process in which the illustration can be brought about by hydrophilizing the surface in the pattern of an image and the erasing is brought about by full-area hydrophobization.

A printing form according to the present invention has an absorption layer under the top layer, on the surface of which the printing style is produced. The absorption layer is correspondingly heated locally by a short-term, local irradiation, i.e., it is heated in the pattern of an image with locally warm areas and cold areas compared with these warm areas in the pattern of an image. The absorption layer should be uniformly thin for the heating in the pattern of an image in order to release the heat primarily at right angles to the absorption layer to the top layer with the photocatalytically and thermally modifiable material, which top layer preferably lies directly on top of it, and to prevent the equalization of the heat within the absorption layer in the tangential direction between the areas of the absorption layer which are locally warm and cold in the pattern of an image. The heat produced locally in the pattern of an image in the absorption layer is transferred by heat conduction from the absorption layer into the top layer, so that the lipophilic areas of the printing style are formed on the surface of the top layer. The two layers are connected to one another over the full area in a heat-conducting manner. The absorption layer preferably adjoins the top layer directly. Each of the two layers interacts with radiation from a certain wavelength range, and the top layer interacts with radiation that is absorbed by the absorption layer to an especially great extent to a lesser extent or not at all, i.e., it is transparent to this radiation. The top layer interacts photocatalytically with radiation from another wavelength range, preferably from the IR range, which is let through by the top layer. The top layer is also correspondingly heated in the pattern of an image due to heat conduction from the absorption layer heated in the pattern of an image and forms the lipophilic image areas on its surface due to this heating.

A thermal insulation layer is preferably provided between the absorption layer and a printing form carrier in order to minimize heat losses on the carrier. If an absorption layer is not present, a thermal insulation layer may nevertheless be provided between the top layer and the carrier.

If a thin absorption layer is formed under the top layer, absorption centers in the top layer may be eliminated. This combination represents a further inventive feature. On the other hand, the absorption layer and the absorption centers in the top layer may advantageously also be combined with one another.

The formation of a printing form according to the present invention by means of the absorption layer is also advantageous for an illustration process in which the illustration is carried out by irradiation with UV light and the erasing is carried out by heating.

A diffusion barrier may be advantageously provided between the carrier and the top layer in order to prevent the diffusion of atoms of the carrier, especially of Fe or Al atoms. The diffusion barrier may be formed, e.g., by an $SiO_2$ quartz layer. A layer acting as a diffusion barrier should have a thickness of at most 10 $\mu$m, and such a layer preferably has a uniform thickness of 100 nm or less. A gradual diffusion of, e.g., Fe and/or Al atoms into the top layer could interfere with the semiconductor effect utilized according to the present invention, because the electron band structure of the top layer could be disadvantageously modified by such diffusion effects in the course of the operation of the printing form. The diffusion barrier may be designed at the same time as a thermal insulation layer. A diffusion barrier may also be formed by a layer provided specifically for this purpose, which may be arranged, in principle, between each of the said layers of a printing form according to the present invention. In preferred embodiments, a layer provided specifically as a diffusion barrier is formed between the carrier and the absorption layer if an absorption layer is provided. If a thermal insulation layer is present, the diffusion barrier may be provided between the carrier and the insulation layer or between the insulation layer and the absorption layer that is optionally present. Such a layer acting as a diffusion barrier may be arranged especially preferably directly under the top layer. Foreign atoms, which may possibly originate not only from a carrier but also from another functional layer, can be prevented most reliably from diffusing into the top layer in this case.

The erasing operation of the printing form is carried out by irradiating the surface with UV light. It is ensured during the erasing process according to the present invention that high humidity, which supports the erasing process, is ensured on the printing form surface to be activated, because if humidity is absent on the activated surface, the electron hole pairs produced by the UV radiation are recombined, so that a permanent hydrophilization of the surface is not achieved. Water is preferably fed to the surface during the erasing process by setting a high humidity at the surface. The increase in the humidity compared with the environment may be brought about especially by feeding in water vapor or also by means of the damping unit of a printing press, which is associated with a means for atomizing water in this case. The humidity at the surface and in the vicinity of the surface is preferably such that the air adjoining there is saturated with moisture.

High humidity is, however, not desirable, in general, in the damping unit. For example, water of condensation may thus be formed, which drops on the cylinders and causes disturbances in the printing style. The offset process may also be adversely affected in the course of a production if the evaporation of surface water, which is located on the surface of the printing form or reaches the surface of the printing form during the cracking of an ink film, is made difficult because of the ambient air being saturated with moisture.

The humidity and preferably also the temperature are therefore maintained, i.e., the printing unit is air conditioned in a variant of the present invention such that high humidity exceeding 60% and preferably exceeding 80% is set during the hydrophilization by means of UV radiation, and a markedly lower humidity is set for the hydrophobization of the surface. Furthermore, a markedly lower humidity is also set during the printing process and preferably during all the times outside the hydrophilization by maintaining the humidity level, preferably by air conditioning. Encapsulation of the printing unit simplifies the setting and the maintenance of the desired values of the humidity and preferably also of the temperature in the printing unit and especially at the printing form. Furthermore, the humidity or the climate can be monitored by arranging humidity sensors and preferably also temperature sensors.

Preferred exemplary embodiments of the present invention will be described below on the basis of figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
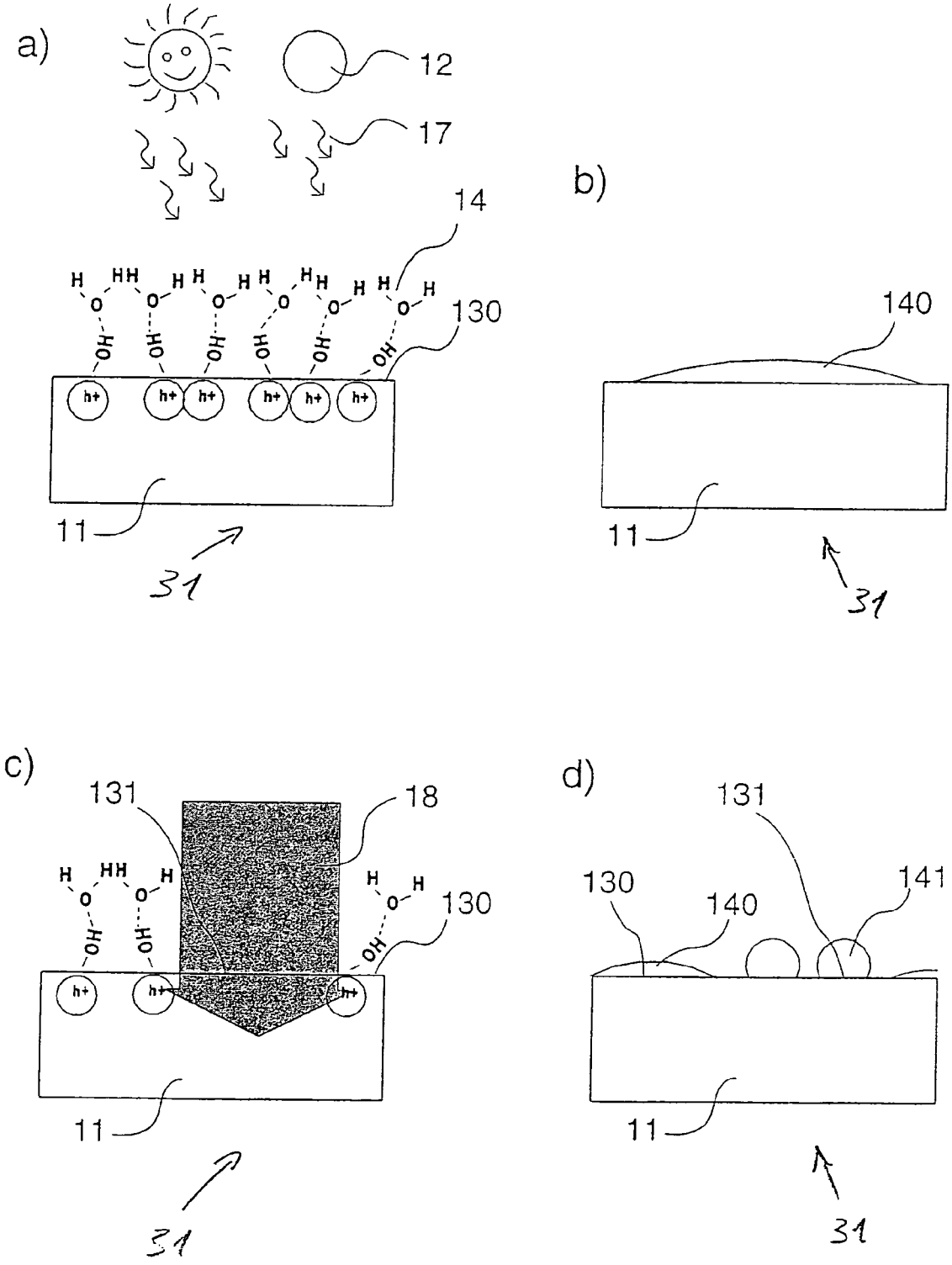
FIG. 1*a* is a schematic view showing a UV-hydrophilic surface.
FIG. 1*b* is a schematic view showing the wetting of the surface.
FIG. 1*c* is a schematic view showing an exposure operation for locally eliminating the hydrophilic character of the surface.
FIG. 1*d* is a schematic view showing the wetting of the surface after the exposure operation.

Referring to the drawings in particular, FIG. 1*a* shows a surface 130 of a wet offset printing form 31, which surface is hydrophilic because of irradiation with light from the UV range and will hereinafter also be called a UV-hydrophilic surface. The surface 130 is formed by a top layer 11 of the printing form 31, which contains a photocatalytically and thermally modifiable material or consists entirely of such a material. The excited state that normally occurs arises from, e.g., the irradiation with natural or artificial daylight because if the layer 11 is irradiated by a light source that emits UV light at least as a component of its spectrum, preferably a daylight source and/or a UV light source 12. The layer 11 is irradiated with high-energy photons 17, so that electrons are excited from the valence band of the photocatalytically and thermally modifiable material into the conduction band in the vicinity of the surface 130 of the layer 11. The electrons missing in the valence band leave behind positive holes h+. If the electric potential of the holes h+ is high enough, the photocatalytically and thermally modifiable material can react with water molecules 14 such that a hydroxyl radical •OH is formed, which binds to the atoms or molecules of the photocatalytically and thermally modifiable material. The hydrophilic character of the surface 130 increases with increasing number of OH groups bound to the surface 130. Water molecules 14 can be bound to the OH groups, in particular, via hydrogen bridges, where the said OH groups themselves are bound to the positive holes h+ of the top layer 11.

FIG. 1*b* shows the wetting of the UV-hydrophilic surface 130 of the layer 11 with a water drop 140. The acute contact angle formed between the edge of the water drop 140 and the surface 130 is an indicator of the hydrophilic character of the surface 130.

A preferred photocatalytically and thermally modifiable material for the top layer 11 of the printing form 31 is titanium dioxide $TiO_2$ in the anatase crystal structure. The excitation energy from the valence band into the conduction band in the anatase structure is approx. 3.2 eV, which corresponds to a wavelength of 387 nm. Excitation of valency electrons of the $TiO_2$ into the conduction band of the semiconductor takes place due to the action of ultraviolet light, whose wavelength is not longer than 387 nm. A positive hole h+ is formed at the same time in the valence band. The excited electron is prevented from falling back to the positive hole h+ if another substance had previously been bound to the activated semiconductor surface. In the case of anatase titanium oxide and certain other semiconductors, this is possible, e.g., when water is present. The hydrophilic state can persist even when no UV light acts any longer on the photothermally modifiable material.

The photocatalytically and thermally modifiable material in the sense of the present invention should have a valence band energy and a conduction band energy, always measured at the two edges of the energy bands facing one another, that are suitable for the reduction and the oxidation of water. The conduction band energy should therefore be at least as negative as the energy necessary for the reduction of water (0.0 V in an acid solution), and the valence band energy should be at least as positive as the energy necessary for the oxidation of water (+1.23 V). A top layer that forms the surface and is formed exclusively by or at least to a high percentage from the photothermally modifiable material has a band gap energy preferably equaling at least 3.2 eV. The energy that is necessary to excite electrons from the valence band into the conduction band is called the band gap energy. The positive holes of the valence band that are formed by the excitation have an advantageously high potential in this case in order to form highly reactive •OH radicals in conjunction with water. Especially preferred materials are the above-mentioned anatase $TiO_2$ and other materials with a suitable electron structure to bind hydroxyl groups on the surface of the material due to excitation with UV light in the manner described. The examples of such, likewise suitable materials include zinc oxide, $ZrO_2$, $SrTiO_3$, $KTaO_3$ or $KTa_{0.77}Nb_{0.23}O_3$, which form, like $TiO_2$, the photocatalytically and thermally modifiable material alone or in a combination of materials consisting of at least two of the above-mentioned materials, including $TiO_2$. The printing form 31 preferably contains at least 40 wt. % of the photocatalytically and thermally modifiable material in the in-depth area decisive for the UV-hydrophilic surface, measured based on the total weight of the material of the printing form forming this area. If the photocatalytically and catalytically and thermally modifiable material is formed by a combination of materials, a combination of $TiO_2$ and $SiO_2$ is an especially preferred material. $SiO_2$ may advantageously also form a material that contains the photocatalytically and thermally modifiable material in combination with one other or a plurality of the said materials.

The hydrophilic character of anatase titanium dioxide as an effect of a photocatalytic reaction is known and is utilized, e.g., in the case of self-cleaning surfaces on buildings and antifogging glasses, especially in automobiles.

Another advantageous property of titanium oxide layers is that they have a self-cleaning effect, because organic particles on the surface are photocatalytically decomposed over time. This also applies to the other of the mentioned materials.

Since a certain amount of ultraviolet light, which continuously excites the surface formed by a photocatalytically and thermally modifiable material, is always present in a normal working environment, it may be assumed that such a surface is normally hydrophilic. The printing form can be erased by natural or artificial daylight. The erasing can be supported by an additional UV source. A UV radiation source used alone or in conjunction with daylight should have a spectrum with a sufficient percentage of UV light with a wavelength of 387 nm. The peak of the emitted spectrum is preferably at a wavelength of 387 nm, corresponding to a band gap energy of 3.2 eV, or at a shorter wavelength. The spectral distribution of the radiation is preferably predominantly below 387 nm. In particular, a UV laser or UV laser system may be used as the UV radiation source. A focusing optical system for the laser or lasers is preferably omitted.

The UV-hydrophilic surface is made locally ink-attracting by treatment with (IR) infrared laser light. The printing form as a whole is not heated substantially in the process. It remains at the temperature which normally occurs in a printing press in the range of 10° C. to 40° C.

FIG. 1*c* shows the elimination of the hydrophilic character of the UV-hydrophilic surface 130. This is accomplished by locally heating the surface 11 in the pattern of an image. The exposure or illustration is carried out by irradiation with laser light 18. The wavelength of the laser light 18 may be in a range from the visible range to the near infrared (NIR), i.e., between approx. 400 nm and 3,000 nm. Laser light from the range of 700 nm to 3,000 nm and especially preferably from the range of 800 nm to 1,100 nm is preferably used for the illustration. A lipophilic surface area 131 corresponding to the laser spot on the surface is produced on the surface 130 by the local exposure to the laser light 18. The heat transfer to the atoms or molecules to which the OH groups are bound brings about the rupture of the bonds. Electrons are subsequently recombined from the conduction band of the photocatalytically and thermally modifiable material of the layer 11 with the positive holes h+. As a result, the hydrophilic character decreases and the printing form 31 becomes lipophilic in the irradiated surface area 131, while the hydrophilic state is preserved in the surface area 130 not irradiated with the laser light 18. Local surface elements, which correspond to a pixel each, of a size of, e.g., 50×50 $\mu m^2$, are heated during the illustration to a temperature of 400° C. to 600° C. for a duration of 1 μsec to 100 μsec, whereas the other areas 130 of the layer 11 remain at ambient temperature. A latent image, which is preserved during the printing, is present on the wet offset printing form 31 after the illustration. The lipophilic pixels 131 transfer the ink during the printing operation.

FIG. 1*d* shows the wetting of the layer 11 by water in the non-irradiated surface area 130 and in the irradiated surface area 131. The wetting by water is slight in the irradiated and consequently heated material in the surface area 131. The contact angle formed between the surface area 131 and the water drop 141 in the surface area 131 is large, and the layer 11 is lipophilic in this surface area 131. To prevent UV light from the environment from leading to a re-excitation of the photocatalytically and thermally modifiable material between the beginning of the exposure and the end of a printing operation, it is sufficient for the printing form to be in a shadow (shielded from direct UV light). This is ensured in the normal case after the mounting of the printing form in a printing press.

FIGS. 2*a* through 2*d* show advantageous exemplary embodiments of a printing form 31 which is built up layer by layer and is preferably designed as a printing plate and can be or already is mounted on a printing form cylinder.

Figure 2:
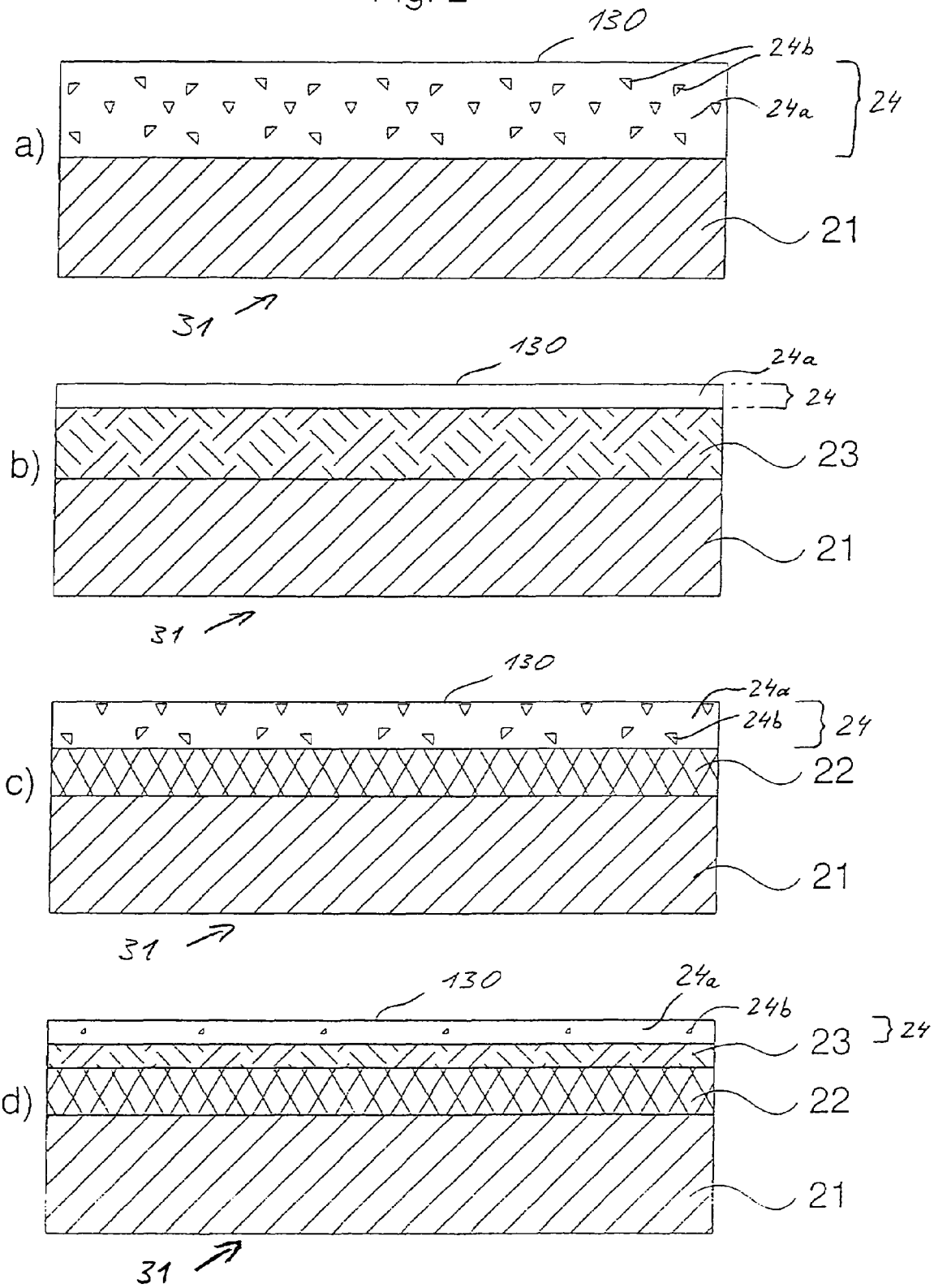
FIG. 2*a* is the cross sectional view of a printing form according to a first exemplary embodiment according to the invention.
FIG. 2*b* is a cross sectional view of a printing form according to a second exemplary embodiment according to the invention.
FIG. 2*c* is a cross sectional view of a printing form according to a third exemplary embodiment according to the invention.
FIG. 2*d* is the cross sectional view of a printing form according to a fourth exemplary embodiment according to the invention.

The printing form 31 according to FIG. 2*a* has a two-layer design with a carrier layer 21 and a single top layer 24, which is applied directly to the carrier layer 21 and on the free surface of which the printing style is produced or, in the case of an illustrated printing form 31, is already present. The layer 24 contains a photocatalytically and thermally modifiable material 24*a* in a sufficiently high percentage to make possible fine illustration pixel by pixel. FIG. 2*a* also illustrates the case in which the layer 24 consists exclusively of a photocatalytically and thermally modifiable material 24*a*.

As in the other exemplary examples as well, the carrier layer 21 is formed by a flexible steel plate or aluminum plate and will hereinafter also be called simply a carrier.

It can be inferred from the electron band structure of a photocatalytically and thermally modifiable material, which forms a hydrophilic surface by UV irradiation, that such a material is transparent in the visible range of the spectrum and in the near infrared (NIR). Thus, there is no interaction with laser light from the visible range of the spectrum and the NIR or with light of an even longer wavelength. To nevertheless generate the heat necessary for the illustration, absorption centers for laser light in the NIR range or the entire IR range may be advantageously created in the top layer of the printing form. The photocatalytically and thermally modifiable material of the top layer is thus heated indirectly by heat conduction.

The top layer 24 in the exemplary embodiment is a dispersion from the photocatalytically and thermally modifiable material 24*a* and absorption particles, which are dispersed in the material 24*a* in a fine, uniform distribution. The absorption particles are nanoparticles of a semiconductor material, which absorbs radiation from the IR wavelength range, and releases it to the surrounding, photocatalytically and thermally modifiable material 24*a*. The absorption particles form the absorption centers 24*b* for the radiation used for the heating. The absorption centers 24*b* may also be formed by particles of a plurality of semiconductor materials.

To prevent too much heat from diffusing in the lateral direction within the top layer of the printing form 31, a sublayer directly adjoining the top layer may be such that it absorbs heat. The materials suitable for such a sublayer, which may also be formed directly by a printing form carrier such as the carrier layer 21, are those that make possible good heat conduction and have good heat capacity. Since a printing form carrier should have a high mechanical strength in order to make possible a permanent mounting within the printing press, such a carrier may consist, e.g., of steel or aluminum.

Depending on the sensitivity of the top layer, it may be advantageous to reduce the release of heat to a carrier in order to increase the image-producing action of the heat generated locally in the top layer. For example, an insulation layer, which reduces the heat conduction to the carrier, may be provided between the top layer and the carrier. The material of the insulation layer should obviously have a low thermal conductivity.

FIG. 2*b* shows an embodiment in which an absorption layer 23 is first applied to the carrier 21 and the top layer 24 is applied to the said absorption layer. In this three-layer structure, heat is generated locally in the pattern of an image in the absorption layer 23 by the irradiation during the illustration. The heat generated in the absorption layer 23 is transferred via the contact surface into the top layer 24, which contains the photocatalytically and thermally modifiable material 24*a*, and it reaches the surface of the top layer 24. As was described above, the heat transfer to the atoms or molecules on the surface, to which the OH groups are bound, beings about the rupture of these bonds, as a result of which recombinations and a decrease in the hydrophilic character take place. The layer thickness of the absorption layer 23 is advantageously 1 μm to 5 μm.

In an embodiment of a special absorption layer 23, the top layer 24 has a uniform thickness of preferably 0.05 μm to 5 μm and especially preferably 0.05 μm to 2 μm. Without an absorption layer, as, e.g., in the first exemplary embodiment, the top layer 24 advantageously has a layer thickness of 1 μm to 30 μm and especially advantageously 1 μm to 10 μm.

FIG. 2*c* shows a third preferred exemplary embodiment. A thermally insulating intermediate layer 22, on which the top layer 24 with the photocatalytically and thermally modifiable material 24 is arranged directly, is located according to the third preferred exemplary embodiment directly above the carrier 21. The thickness of the intermediate layer 22 is preferably between 1 μm and 30 μm. Furthermore, as in the first exemplary embodiment, absorption centers 24*b* are present in a uniformly distributed form in the top layer 24. The top layer 24 preferably has a thickness of 1 μm to 30 μm and especially preferably a thickness of 1 μm to 10 μm.

FIG. 2*d* shows a fourth exemplary embodiment. In this example, a thermally insulating intermediate layer 22, whose thickness is preferably between 1 μm and 30 μm, is located directly above the substrate 21. An absorption layer 23, whose layer thickness is preferably between 1 μm and 5 μm, is arranged directly above the intermediate layer 22. A top layer 24, which contains the photocatalytically and thermally modifiable material 24*a* or consists exclusively of such a material and preferably has a thickness of 0.05 μm to 5 μm and especially preferably 0.05 μm to 2 μm, is arranged on the absorption layer 23.

The top layers 24 in the exemplary embodiments according to FIGS. 2*b* and 2*d* may likewise have dispersed absorption centers, even though the incorporation of absorption centers in the photocatalytically and thermally modifiable material may be done away with because of the absorption layer 23. Nevertheless, a top layer 24 with dispersed absorption centers 24*b* is formed in the exemplary embodiment according to FIG. 2*d*.

As examples, the sol-gel process and the CVD (Chemical Vapor Deposition) process are suitable for applying the top layer and one or more additional layers. The layer or layers may be applied directly one on top of another, i.e., without intermediate layers, e.g., bonding layers.

Figure 3:
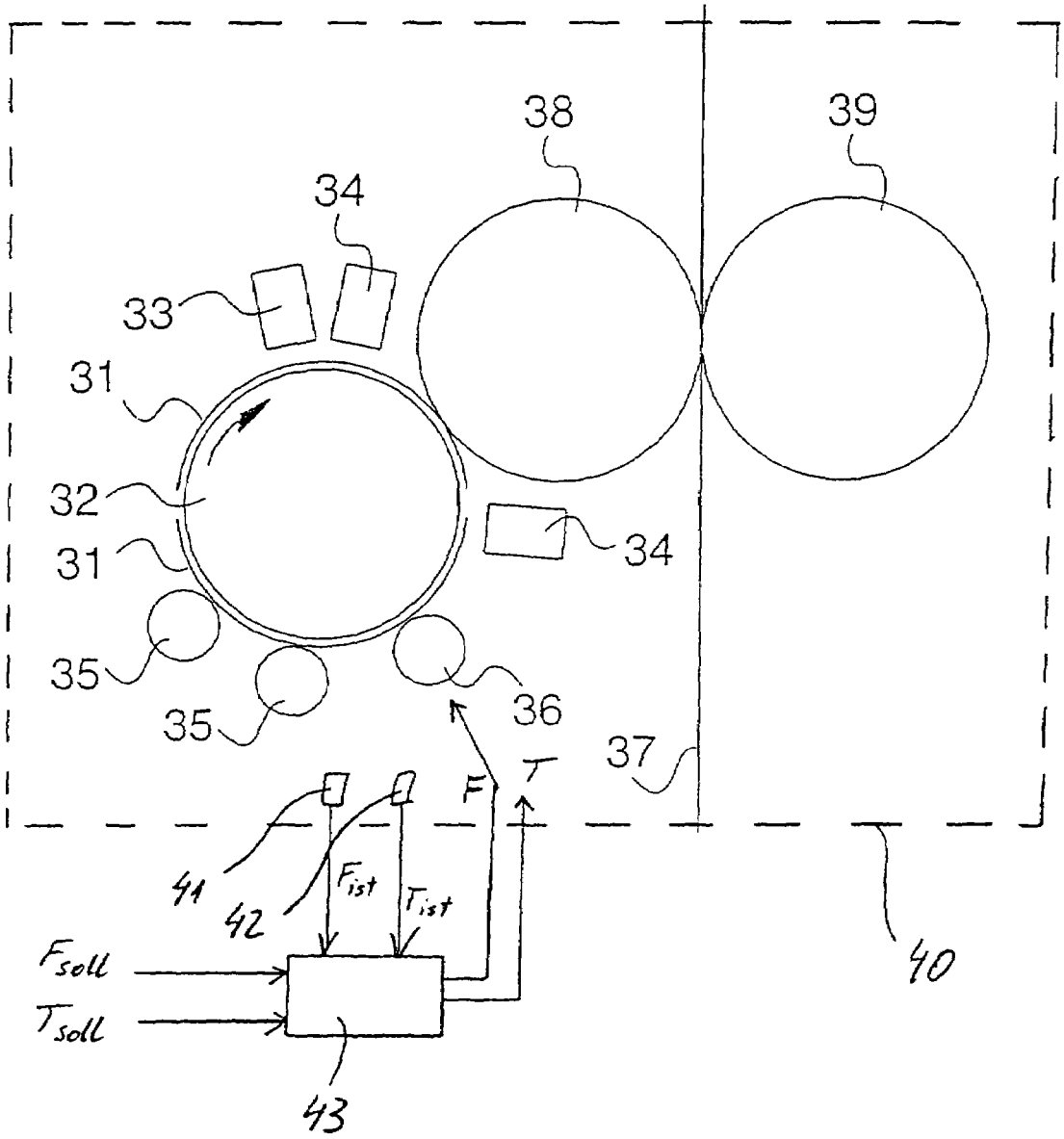
FIG. 3 is a printing unit of a web-fed wet offset rotary printing press according to the invention.

FIG. 3 shows a printing unit with a printing form cylinder 32, an associated rubber blanket cylinder 38 and an impression cylinder 39, which forms a printing gap for a web 37 to be printed on with the rubber blanket cylinder 38. Two printing plates 31 are fastened to the printing form cylinder 32 in the known manner. Each of the two printing plates 31 is formed by a printing form according to the present invention, e.g., according to one of the exemplary embodiments shown in FIGS. 2*a* through 2*d*. An imaging means 33, two erasing means 34, ink applicator rolls 35 and a damping agent applicator roll 36 are arranged in the printing press, distributed over the circumference around the printing form cylinder 32. A film of damping agent, preferably a water film, is brought to the printing forms 31 by means of the damping agent applicator roll 36 in the known manner. Ink, which is first transferred from the printing forms 31 to the rubber blanket cylinder 38 and from there to the web 37, is transferred in the pattern of an image, likewise in a known manner, by means of the ink applicator rolls 35 during printing. The impression cylinder 39 itself may be a rubber blanket cylinder of another printing unit for two-sided printing, a steel cylinder for only a single printing side or a steel cylinder of a satellite printing unit, e.g., a 9- or 10-cylinder printing unit.

The imaging means 33 directly faces the surface of the printing form 31 to be illustrated and is arranged in parallel to the axis of rotation of the printing form cylinder 32. The imaging unit 33 has a plurality of lasers arranged next to one another along the axis of rotation of the printing form cylinder 32. The laser spots of these lasers are focused on the surface of the printing form 31. The lasers of the imaging means 33 are preferably integrated within one or more laser arrays arranged next to one another. Preferred embodiments of the imaging means are described in DE 199 11 907 A1 (see also EP1036656) the contents of which is hereby incorporated by reference, which is referred to as an example.

The two erasing means 34 have at least one daylight radiation source each and/or at least one UV radiation source. The erasing means 34 are arranged at spaced locations from one another over the circumference of the printing form cylinder 32 in parallel to the axis of rotation of the printing form cylinder 32. A single erasing means 34 would suffice, in principle, to erase the illustrated surface of the printing forms 31 by reverting the photothermally modifiable material forming the respective surfaces into a hydrophilic normal state in relation to the particular printing style by full-area irradiation with light from the UV range.

The erasing means 34 are switched off during the illustration. No rolls or cylinders are preferably in contact with the printing form cylinder 32, especially the printing forms 31, during the illustration in order to ensure the smoothest possible rotation of the printing form cylinder 32. The erasing means 34 are switched on after the completion of the printing. The surfaces of the printing forms 31 are wetted with water during the erasing in order to render the previously lipophilic surface areas excited by UV radiation permanently hydrophilic by binding OH groups. Especially the damping unit or a steam generator may be used for this purpose.

In a variant, the printing unit, which comprises the printing form cylinder 32 and the rubber blanket cylinder 38, is encapsulated and air conditioned against the environment in order to make it possible to optimally adapt the humidity as well as the temperature to the particular operating conditions. Thus, a uniformly high humidity of at least 60% and preferably at least 80% should prevail within the encapsulation 40 during the erasing operation, whereas the humidity should be markedly lower for the illustration and the running printing production. The encapsulation 40 preferably also encloses the impression cylinder 39, as in the exemplary embodiment. If the printing unit comprises additional cylinders, the additional cylinders belonging to the printing unit are preferably also enclosed by the encapsulation 40. If the printing units of the printing press are rubber-rubber printing units, the encapsulation 40 preferably encloses the two rubber blanket cylinders engaged with one another and the printing form cylinders associated with them. In the case of printing units formed in this manner, encapsulations 40 may also be formed for the usual H or N bridges, i.e., for four rubber blanket cylinders each and their respective plate cylinders. In satellite printing units with nine or ten cylinder units, these units are preferably enclosed by an encapsulation 40 of their own.

Even though a damping unit proper is already advantageous to set the high humidity for the UV radiation and to maintain it during the irradiation within the encapsulation 40, air conditioning with the simultaneous setting and maintenance of a preset temperature within the encapsulation 40 is preferred. The air conditioner used to set and maintain a preset humidity $F_{soll}$ and a preset temperature $T_{soll}$ comprises in the exemplary embodiment, besides the encapsulation 40 and the means for feeding in water, the damping agent applicator roll 36, a humidity and temperature regulator 43, and at least one humidity sensor 41 arranged within the encapsulation 40 and at least one temperature sensor 42 arranged within the encapsulation 40. The sensors 41 and 42 detect the humidity and the temperature within the encapsulation 40 and send both the humidity and the temperature as a controlled variable $F_{ist}$ and $T_{ist}$ each to the regulator 43. The regulator 43 forms the respective differences $F_{soll}-F_{ist}$ and $T_{soll}-T_{ist}$ from the difference of the recorded humidity and temperature values and the preset values and form the humidity manipulated variable F and the temperature manipulated variable T for the means operating within the encapsulation 40 for feeding in water and for influencing the temperature as a function of the humidity difference and the temperature difference.

Illustration and erasing in the printing press is preferred, especially the illustration and the erasing on the printing form cylinder, on which the printing form is also fastened during the printing production or is integrated on the cylinder. However, the illustration and the erasing may, in principle, also be carried out outside the printing press. Carrying out one of the operations in the printing press and carrying out of the other operations outside the printing press shall not be excluded, either.

While specific embodiments of the invention have been shown and described in detail to illustrate the application of the principles of the invention, it will be understood that the invention may be embodied otherwise without departing from such principles.

What is claimed is:

1. A process for erasing or illustrating a printing style of a wet offset printing form, comprising the steps of;

providing a form which contains on a surface forming the printing style a photocatalytically and thermally modifiable material that can be brought into a hydrophilic state by irradiation with light and into a lipophilic state by heating;

erasing or producing a printing style by irradiating said surface with UV radiation; and feeding water to said surface during the irradiation;

wherein a lower humidity is set in the lipophilic state than in the hydrophilic state.

2. A process in accordance with claim 1, wherein a humidity of at least 60% is generated at said surface for the UV irradiation, and it is maintained for the duration of the UV irradiation.

3. A process in accordance with claim 1, wherein a preset temperature is set and maintained for the duration of the UV irradiation.

4. A process in accordance with claim 1, wherein an illustrated surface of said form is irradiated over its entire area for erasing.

5. A process in accordance with claim 1, wherein:

an IR absorption component is mixed with said modifiable material.

6. A process in accordance with claim 1, wherein:

an IR absorption component and said modifiable material are separate layers in said printing form.

7. A device for repeatedly illustrating a wet offset printing form, the device comprising:

a form with a surface that can be or is already illustrated, the form having a photocatalytically and thermally modifiable material, which can be brought photocatalytically into a hydrophilic state by irradiation with light and into a lipophilic state by heating;

an imaging means for producing a printing style by heating said photocatalytically and thermally modifiable material in the pattern of an image;

an erasing means for erasing the printing style produced, wherein said erasing means has one or more radiation sources for daylight and/or UV light; and a humidifying unit for air conditioning by which a preset humidity can be generated and maintained at said form to be lower in said lipophilic state and higher in said hydrophilic state.

8. A device in accordance with claim 7, wherein said humidifying unit includes an encapsulation for said wet offset printing form and a plurality of cylinders of a printing unit so as to generate and maintain a preset humidity within said encapsulation.

9. A device in accordance with claim 8, wherein said humidifying unit comprises at least one humidity sensor arranged within said encapsulation and a regulator, to which the humidity value detected by the humidity sensor is sent as a controlled variable.

10. A device in accordance with claim 7, wherein said erasing means has one or more radiation sources for the full-area irradiation of said surface.

11. A device in accordance with claim 7, wherein the radiation source or radiation sources of said erasing means emits/emit a large percentage of radiation of a wavelength of at most 387 nm, wherein a wavelength spectrum emitted by the radiation source has a peak at a wavelength of 387 nm.

12. A device in accordance with claim 7, wherein said printing form is arranged detachably and nondetachably on a printing form cylinder in a wet offset web-fed rotary printing press and said erasing means is directed toward said printing form cylinder and preferably extends over a length of said printing form measured in parallel to an axis of rotation of said printing form cylinder over such an extent that a full-area, uniform irradiation of said printing form can be carried out.

13. A device in accordance with claim 7, wherein said imaging means comprises a plurality of radiation sources for the irradiation of said printing form in the pattern of an image.

14. A device in accordance with claim 7, wherein said imaging means includes a radiation source with one of IR lasers and NIR lasers.

15. A device in accordance with claim 7, wherein said printing form is arranged detachably or nondetachably on a printing form cylinder in a wet offset printing press and said imaging means includes a radiation sources directed toward said printing form cylinder and are arranged next to one another in parallel to an axis of rotation of said printing form cylinder.

16. A device in accordance with claim 7, wherein:

said printing form includes an IR absorption component.

17. A device in accordance with claim 16, wherein:

said IR absorption component is mixed with said modifiable material.

18. A device in accordance with claim 16, wberein:

said IR absorption component and said modifiable material are separate layers in said printing form.

19. A wet offset printing arrangement comprising:

a printing form having a photocatalytically and thermally modifiable material which is photocatalytically changed into a more hydrophilic state by irradiation with light, and into a lipophilic and a less hydrophilic state by heating, an imaging device heating said photocatalytically and thermally modifiable material in a pattern of an image;

a UV radiation source substantially uniformly exposing said photocatalytically and thermally modifiable material; and a humidifying unit providing a humidity at said form which is lower in said lipophilic state and higher in said hydrophilic state.

20. An arrangement in accordance with claim 19, wherein:

said printing form includes a carrier layer and an insulating layer, an insulating layer being arranged between said carrier layer, and one of said IR absorption component and said modifiable material;

said IR absorption component is one of mixed with said modifiable material, or in a separate layer from said modifiable material.

21. An arrangement in accordance with claim 19, wherein:

said printing form includes an IR absorption component.

22. A process for erasing or illustrating a printing style of a wet offset printing form, comprising the steps of;

providing a form which contains on a surface forming the printing style a photocatalytically and thermally modifiable material that can be brought into a hydrophilic state by irradiation with light and into a lipophilic state by heating;

erasing or producing a printing style by irradiating said surface with UV radiation; and feeding water to said surface during the irradiation;

wherein a preset temperature is set and maintained for the duration of the UV irradiation.

23. A device for repeatedly illustrating a wet offset printing form, the device comprising:

a form with a surface that can be or is already illustrated, the form having a photocatalytically and thermally modifiable material, which can be brought photocatalytically into a hydroplilic state by irradiation with light and into a lipophilic state by heating;

an imaging means for producing a printing style by heating said photocatalytically and thermally modifiable material in the pattern of an image;

an erasing means for erasing the printing style produced, wherein said erasing means has one or more radiation sources for daylight and/or UV light; and a humidifying unit for air conditioning by which a preset humidity can be generated and maintained at said printing form, wherein a preset temperature is set and maintained for the duration of the UV irradiation.

24. A wet offset printing arrangement comprising:

a printing form having a photocatalytically and thermally modifiable material which is photocatalytically changed into a more hydrophilic state by irradiation with light, and into a lipophilic and a less hydrophilic state by heating;

an imaging device heating said photocatalytically and thermally modifiable material in a pattern of an image;

a UV radiation source substantially uniformly exposing said photocatalytically and thermally modifiable material;

a temperature regulator setting and maintaining a preset temperature for the duration of the UV irradiation.

* * * * *